United States Patent [19]

Gartner et al.

[11] Patent Number: 4,926,664

[45] Date of Patent: May 22, 1990

[54] SELF LOCKING ELECTRONIC LOCK

[76] Inventors: Klaus W. Gartner, 2632 Via Anacapa, Palos Verdes Estates, Calif. 90274; Alan K. Uyeda, 8317 Elsomore Dr., Rosemead, Calif. 91770

[21] Appl. No.: 311,696

[22] Filed: Feb. 16, 1989

[51] Int. Cl.[5] ..... E05B 49/00

[52] U.S. Cl. ..... 70/119; 70/278

[58] Field of Search ..... 70/278, 277, 279, 280, 70/282, 283, 118, 119; 292/144, 33, 34, 36, 40, 37

[56] References Cited

U.S. PATENT DOCUMENTS

| | | | |
|---|---|---|---|
| 2,823,536 | 2/1958 | Watson | 70/118 |
| 3,702,070 | 11/1972 | Gartner . | |
| 3,758,734 | 9/1973 | Gartner . | |
| 4,148,092 | 4/1979 | Martin . | |
| 4,665,727 | 5/1987 | Uyeda . | |
| 4,714,030 | 12/1987 | Cole | 70/27 B |
| 4,745,784 | 5/1988 | Gartner . | |

*Primary Examiner*—Robert L. Wolfe

*Attorney, Agent, or Firm*—Poms, Smith, Lande & Rose

[57] ABSTRACT

A self locking electronic lock system is illustrated in association with safe doors having a door locking bolt works manipulated between door open and door locked positions by a door mounted handle. The bolt works includes a link which moves the door bolts and in turn is locked by an electronic lock in accordance with the present disclosure. The electronic lock has a spring bias bolt normally biased into a locking gate provided on the link and is operated to a withdrawn position by an associated digital input electronic signal generating means. A lost motion connection is provided between an electric motor of the lock and the lock bolt such that the motor withdraws the lock bolt on entry of a correct combination to the digital input means and the lock bolt is biased back into locking engagement with the link gate by operation of an operator closing the safe door and manipulating the door handle to throw the door bolts into engagement with the safe door jam, the electronic lock bolt automatically locking up with the bolt works link to prevent reopening of the door until the combination is entered again due to the bias of the lock bolt toward the link gate.

12 Claims, 5 Drawing Sheets

SELF LOCKING ELECTRONIC LOCK

INTRODUCTION

Generally stated the present invention relates to electrically operated locks for safe doors and the like and more particularly to an automatically self locking electronic lock system for use with safe doors having manually operated bolt works.

BACKGROUND OF THE INVENTION

Various types of electrical locks for safe doors and the like have been developed heretofore as shown in prior patents to one of the inventors herein Klaus W. Gartner, including U.S. Pat. Nos. 3,702,070; 3,758,734; and 4,745,784. These patents show various types of electrical input means for operating an electrical lock for locking a safe door or the like. Another electronic combination door lock which senses the position of an associated dead bolt operated by the electrical means is illustrated in U.S. Pat. No. 4,148,092.

In these prior exemplary electronic lock mechanisms, and in other known prior electronic lock mechanisms, the associated locking mechanisms have not been automatically self locking. Specifically, in the case of a safe door which has a manually operated bolt works thrown between door locking and unlocking conditions by the turning of a door handle, the door can be closed with the door handle in an apparent bolt locking position, easily visible to an observer thereof, but the associated lock mechanism may or may not be locked depending upon whether the associated dial mechanism or electronic lock mechanism also has been adjusted to a locking mode or condition. In certain commercial utilizations, employees handling money during the working day may prefer not to have to manipulate and electronic or combination lock to open and close the safe and simply throw the bolt works of the door into a locked condition when the safe door is closed, the door then appearing to be in a locked condition even though it is not.

SUMMARY OF THE INVENTION

In view of the foregoing, it is primary object of the present invention to disclose and provide an automatically self locking electronic lock for safe doors, and the like, wherein the closing of the safe door and manipulation of the associated bolt works provides an automatic locking of the associated electronic locking mechanism so that the door will be fully locked when closed and an associated handle is in a door bolt works locking position. It is a further object of the present invention to disclose and provide such an electrically operating lock mechanism which is easily manufactured, simply operated and easily assembled into preexisting bolt works of known construction for preexisting as well as newly constructed safe doors.

Generally stated, the present invention in a self locking electronic lock for use with a safe door having manually operated bolt works, wherein the bolt works includes a door handle on the outside of the door and a linkage on the inside of the door operated by such handle and the provision of a lock mechanism having a lock bolt normally biased into a linkage engaging and locking position together with a mounting means for mounting such lock bolt relative the linkage so that the bolt is normally biased into a linkage locking position. Electronically driven means are provided in accordance with the present invention, for withdrawing the lock bolt against its bias from a locking engagement with the bolt works linkage to allow manipulation of the linkage by the safe door handle to release the bolt works and open the door. Specifically, the present invention contemplates the provision of a lost motion connection between the lock bolt and the electrically driven means whereby after opening of the safe door, the electrically driven means can be reversed to, through the lost motion connection with the lock bolt, release the lock bolt which can then simply abut a portion of the linkage adjacent a linkage gate which the lock bolt enters to lock the linkage. A reversible electric motor may be provided in the electronic lock for operating an associated follower block which rides within a slot provided within the lock bolt to accomplish the aforementioned bolt withdraw and release movements. An electrical signal for operating the electrical motor is preferably generated by an electronic combination input means with the motor being first driven in a direction to withdraw the lock bolt, then be operated in a dwell mode during which the door bolts may be swung to an unlock condition through manipulation of the linkage and then in a bolt release motion whereby the bolt is released from its electrical drive. On manual manipulation of the bolt works linkage to throw the door bolts back into a door locking condition, the biased lock bolt rides along a portion of the linkage adjacent the link gate and automatically snaps into such link gate to lock the linkage against reopening of the safe door until the predetermined combination is entered once again through the code input means to generate a lock opening signal to the electrical motor associated with the lock bolt.

It is believed that a more complete understanding of the present invention, as well as the appreciation of additional objects and advantages thereof will be afforded to those skilled in the art from a consideration of the following detailed description of a preferred exemplary embodiment thereof. Reference will be made to the appended sheets of drawings which will be first briefly described.

DETAILED DESCRIPTION OF A PREFERRED EXEMPLARY EMBODIMENT

Figure 1:
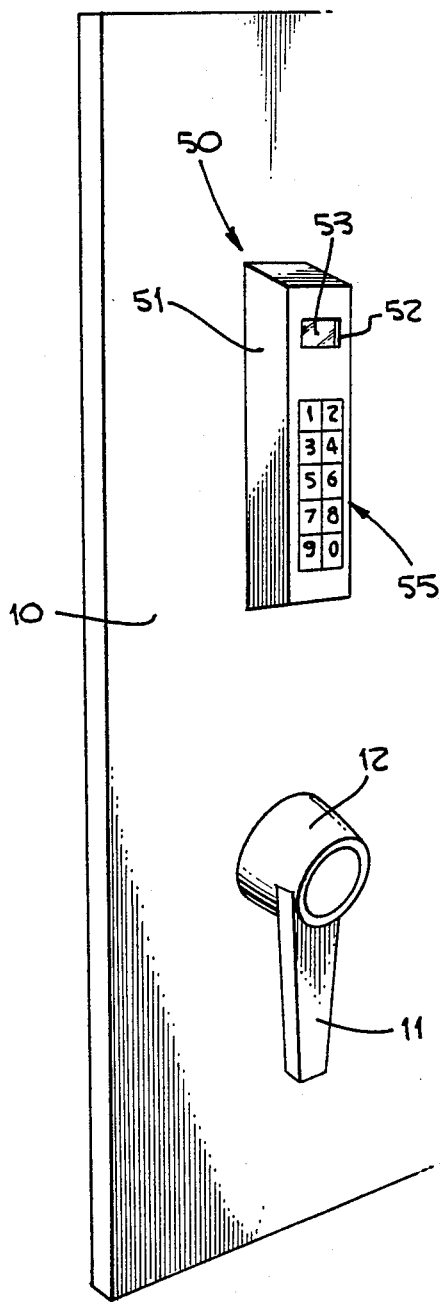
FIG. 1 is a front elevational view of an exemplary safe door having a manually operable handle associated with bolt works on the rear side of the door and an exemplary electronic lock combination entry push pad and circuit board means for generating a lock opening signal when a predetermined combination of push pad manipulations are accomplished.
Figure 2:
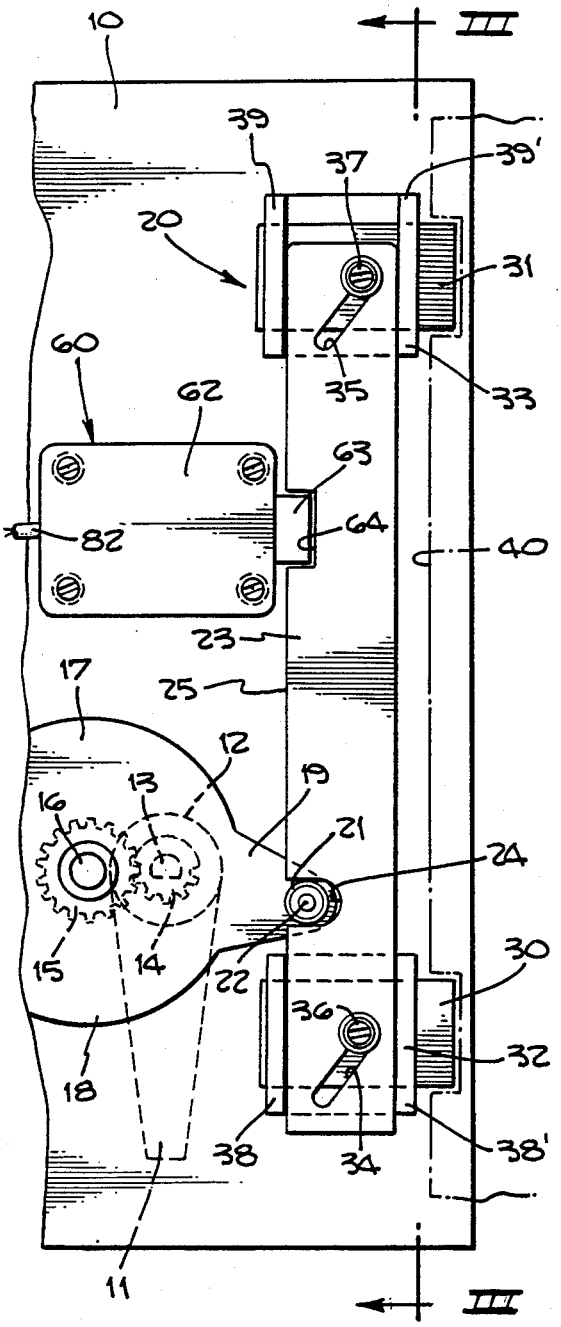
FIG. 2 is a rear view of the safe door of FIG. 1 showing an exemplary embodiment of bolt works shown in a door locking condition and being held in such locked condition by the preferred exemplary embodiment of self locking electronic lock in accordance with the present invention.
Figure 3:
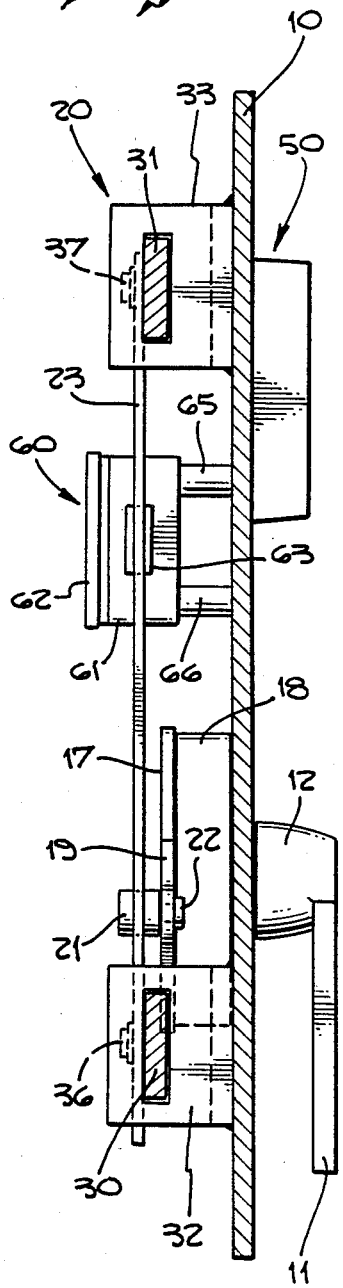
FIG. 3 is a vertical section view through the safe door and bolt works of FIG. 2 taken therein along the plane III—III.
Figure 4:
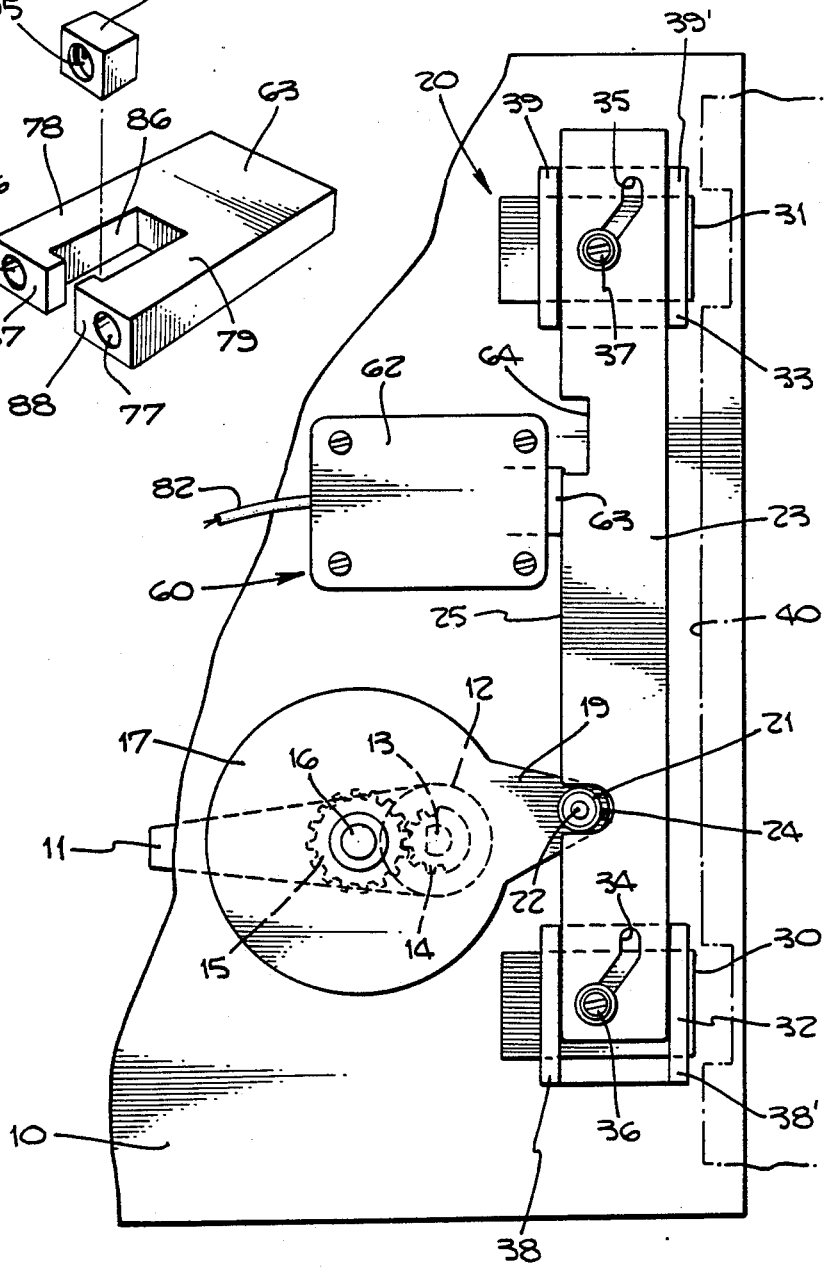
FIG. 4 is a view as in FIG. 2, showing the safe door bolt works in a door unlocking condition and with the self locking electronic lock of the present invention shown with its lock bolt engaging against an end surface of the vertical link of the exemplary bolt works.

Referring initially to FIGS. 1 through 3, an exemplary safe door 10 is illustrated as having a manually operable handle 11 on the outer, front side of the door and a door locking bolt works, indicated generally at 20 provided on a inner, rear side of the door as seen in FIGS. 2 and 3. Door handle 11 includes an integral handle boss 12 which is secured to handle shaft 13 which passes through an appropriate journal surface provided through the door. On the inner side of the door 10, shaft 13 is provided with a drive gear 14, mounted on a flatten inner end of shaft 13 as seen in FIGS. 2 and 4, so that gear 14 rotates with manual rotation of handle 11 as seen in FIGS. 2 and 4. Drive gear 14 meshes with a driven gear 15 which in turn is fixed by a mounting journal 16 secured to the wall 17 of driven shell 18. An extension 19 is provided on wall 17 to mount the roller 21 via a mounting pin 22 to allow manipulation of the bolt works indicated generally at 20.

In the exemplary embodiment, the bolt works indicated generally at 20 includes the provision of linkage including the vertical link 23 having roller slot 24 whereby manipulation of handle 11 in a clockwise direction as viewed in FIG. 1, shifts the link 23 upwardly as seen in comparison in FIGS. 2 and 4, the link having been raised in FIG. 4. Door bolts 30 and 31 are mounted in mounting journal blocks 32 and 33 to the rear of door 10, as by welding, so that the bolts 30 and 31 are moveable between their outer, door locking position of FIG. 2 and the inner, door release position of FIG. 4. The bolts are manipulated through such movement by link 23 through the inclined slot and follower pin connections provided by the incline slots 34 and 35 on link 23 and the follower pins 36 and 37 provided on blocks 30 and 31, respectively. As shown seen in FIG. 2, link 23 slides between the end plates 38, 38' and 39, 39' of the mounting blocks 32 and 33 during its vertical movement from the position of FIG. 2 to that of FIG. 4 to cause a withdraw of the door bolts 30 and 31 when the door handle is turned a quarter turn in the clockwise direction of FIG. 1. As in phantom line in FIGS. 2 and 4, door bolts 30 and 31 are adapted to fit within appropriate bolt receptacles in the door jam 40.

Figure 13:
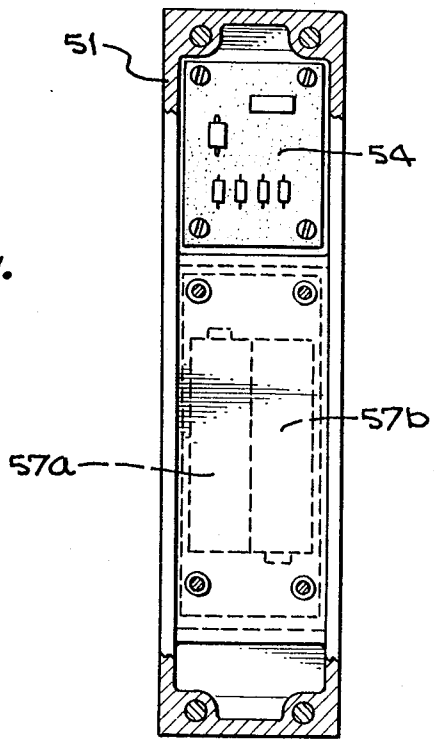
FIG. 13 is a rear view of the digital input means and signal generating means of FIG. 11.
Figure 11:
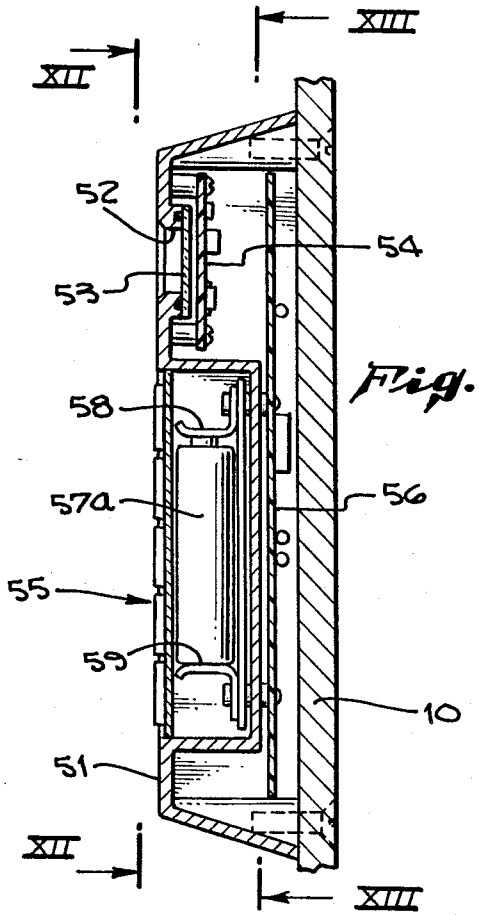
FIG. 11 is a vertical section view through an exemplary embodiment of electronic code digital input means and signal generating means.
Figure 12:
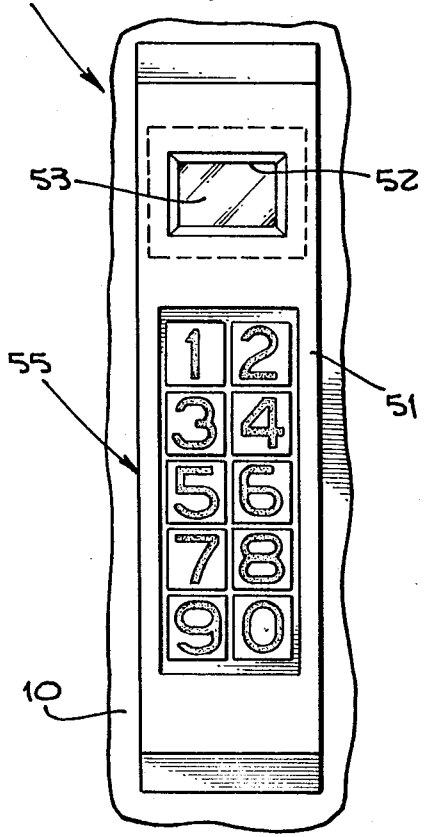
FIG. 12 is a front view of the digital input means and signal generating means of FIG. 11.

Referring once again to FIG. 1, an exemplary embodiment of an electronic code input means indicated generally at 50. Such electronic code input means are already well known in the art of electronic locks as in part disclosed in prior Pat. Nos. 4,745,784; 4,148,092, and application for U. S. Letters Patent entitled "ELECTRONIC DOOR LOCK", Ser. No 07/193,520, filed May 11, 1988, the disclosures of which are incorporated herein by this reference. The exemplary input means include in general, a housing or face plate 51 secured to the front side of the safe door 10 as seen in FIG. 1 and associated electronic circuitry within the housing and face plate as seen in FIGS. 11 and 13. In the exemplary electronic code input means, indicated generally 50, the face plate 51 has a viewing aperture 52 with a transparent window 53 which is positioned directly in front of a liquid crystal display means 54 for displaying a numeral corresponding to the individual one of the push pads, indicated generally at 55, depressed by the individual attempting to enter the safe door. The individual code, whether it be numeric or alphabetical, is recorded as a sequence of input signals by the printed circuit board 56. The push button means, liquid crystal display unit and circuit board are powered by a self contained power source such as the batteries 56*a* and 57*b* which are held within face plate 51 by the two spring retainer electrical connectors 58 and 59 as seen in FIG. 11. As is known in the art, when a predetermined sequence of codes is entered via the push pads 55, the circuit board 56 recognizes the correct combination and puts out a lock opening signal to the associated lock means.

Figure 6:
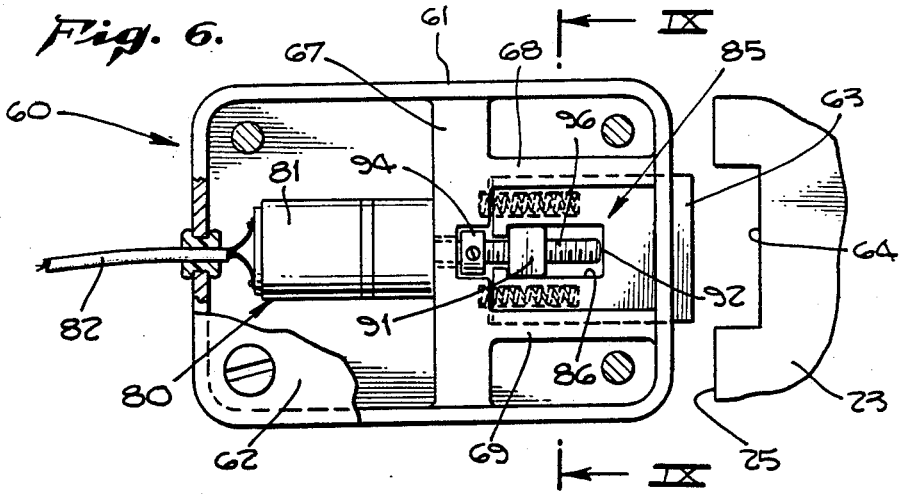
FIG. 6 is a rear elevational view, with the lock housing cover partially removed, showing the preferred exemplary embodiment of self locking electronic lock in accordance with the present invention, the lock bolt being withdrawn by the associated motor means to release the associated bolt works linkage.

As is particularly contemplated within the present invention, the electronic lock of the present invention is self locking when the safe door is closed and the bolt mechanism is returned to the door bolt locking position of FIG. 2. In the exemplary embodiment, such self locking electronic lock is indicated generally at 60 in FIGS. 1–4 and 6–8 and includes a lock housing 61, as seen in FIGS. 3 and 6, normally enclosed by a cover plate 62 as seen in FIGS. 2–4. The lock bolt 63 is adapted to fit within gate 64 of link 23 when the electronic lock, indicated generally at 60 is in a bolt works locking condition as seen in FIG. 2. Lock housing 61 may be mounted by appropriate mounting bolts 65 and 66 to the interior of safe door 10 as seen in FIG. 3 to position lock bolt 63 in alignment with gate 64 to be normally in engagement therewith when the lock bolts are in their locking position as seen in FIGS. 2 and 3.

Figure 9:
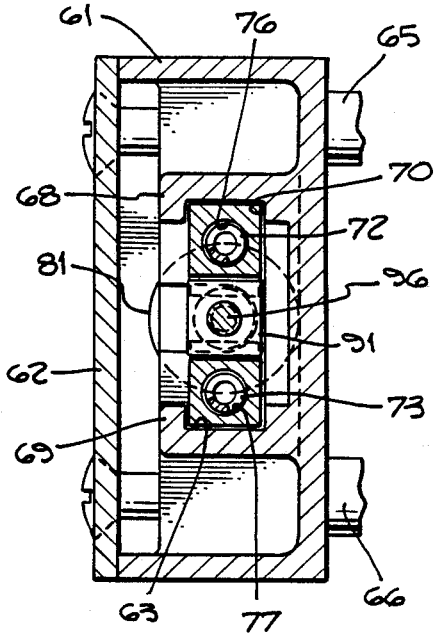
FIG. 9 is a vertical section view through the preferred exemplary embodiment of self locking electronic lock of FIG. 6 taken therein along the plane IX—IX.
Figure 7:
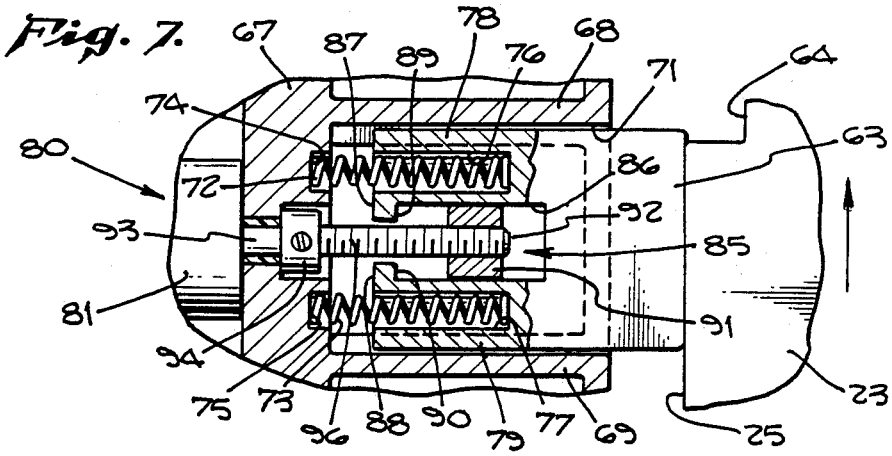
FIG. 7 is a view as in FIG. 6 showing the lock bolt released by the lost motion connection between the lock bolt and the electric motor means with the lock bolt abutting the associated lock bolt works linkage under the bias of its associated spring means.
Figure 8:
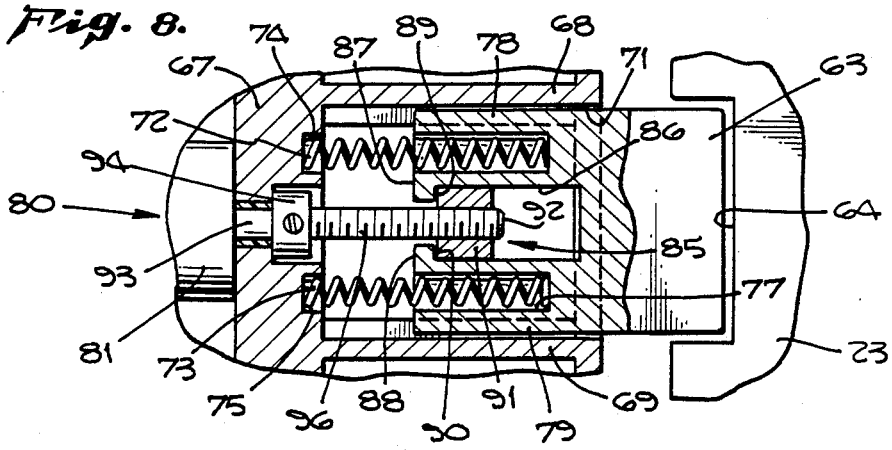
FIG. 8 is a view as in FIG. 7 showing the lock bolt having automatically entered a gate in the bolt works linkage when the vertical link has been shifted vertically relative the lock bolt as seen in FIGS. 7 and 8 as is accomplished in the present exemplary embodiment when the safe door is closed and the door handle is moved to throw the safe door bolts into door locking position.

Referring now more specifically to FIGS. 6 through 9, the exemplary electronic lock housing 61 is provided with a central web 67 which is integral with webs 68 and 69 which, together with a base wall 70 as best seen in FIG. 9, provide a slide way 71 for bolt 63. Bolt 63 is biased by spring means to normally extend outwardly of slide way 71 and housing 61 as seen in FIG. 8. Such spring means in the exemplary embodiment include the coil springs 72 and 73 which sit in mounting bores 74 and 75 in web 67, as seen in FIGS. 7 and 8, and fit within spring receiving bores 76 and 77 formed within the leg 78 and 79 of bolt 63. As seen in FIG. 7, such outward bias for bolt 63 causes it to rest against an inner edge surface 25 of link 23.

Figure 10:
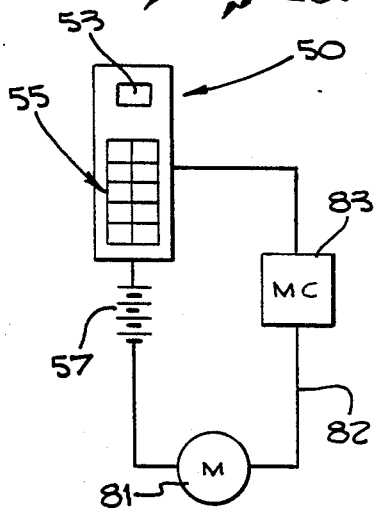
FIG. 10 is a simplified schematic of an exemplary circuit for operating the reversible motor of the electronic lock of the present invention.

Electrically driven means are provided in the exemplary embodiment for withdrawing the lock bolt 63 against its bias of springs 72 and 73 from the gate 64 on actuation thereof in response to a correct input of a predetermined code through the electrical input means indicated generally at 50. In the exemplary embodiment, such electrically driven means are indicated generally at 80 in FIGS. 6 through 8 and include a reversible electric motor 81 which is connected by suitable electrical wiring 82 to the code input means, indicated generally at 50, and its associated batteries 57 as shown schematically in FIG. 10. A motor control and timing means 83 is provided in the circuit for controlling operation of the motor as subsequently described.

Figure 5:
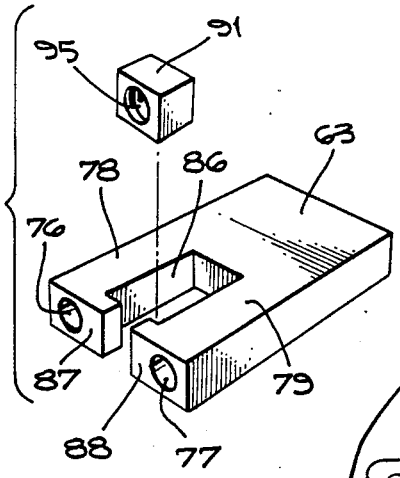
FIG. 5 is a detail, exploded view of a preferred exemplary embodiment of lock bolt and follower block employed in the lost motion connection between the lock bolt and the electrically driven motor means of the preferred exemplary embodiment of self locking electronic lock.

As particularly contemplated within the present invention, a lost motion connection, indicated generally at 85 is provided between bolt 63 and motor 81 for selectively driving and releasing bolt 63 as will now be described. As best seen in FIG. 5, bolt 63 has a slot 86 formed between legs 78 and 79 with inturned foot portions 87 and 88 providing outer stop surfaces 89 and 90 for slide 86 as best seen in FIG. 7. A slide block 91 is provided to fit within slide 86 and be moved forwardly and backwardly therein by operation of the threaded shaft 92, connected to motor shaft 93 by coupling 94 as seen in FIGS. 7 and 8, the block 91 having an internal thread 95 adapted to mate with the external thread 96 on shaft 92.

Upon entry of a predetermined combination via the push pads, indicated generally at 55, the printed circuit board 56 in association with its power source of batteries 57*a* and 57*b* produces an output signal communicated via electrical lines 82 to motor 81 to operate the motor to rotate the shaft 92 in a first given direction to withdraw the slide block 91 inwardly of housing 61 sufficiently to withdraw bolt 63 from gate 64 as seen in FIG. 6. Suitable electronic motor control and timing means 83 may be provided, as known in the art, to provide for a first timed operation of motor 81 in a first direction of rotation to withdraw bolt 63, then provide a second timed dwell therefor while the motor remains stationary and thereafter a third timed motor operation wherein motor 81 is reversed and driven in a reverse direction to return the slide block 91 via its lost motion connection to the position of FIG. 7. If the safe door is opened during the dwell period by rotating handle 11 a quarter turn in a clockwise direction as seen in FIG. 1, the bolt works including link 23 will be moved to open the safe door and place the inner edge 25 in alignment with the bolt 63 as seen in FIG. 7. Following the dwell period, when the slide block 91 is returned to its lock bolt release position as seen in FIG. 7, the bolt 63 is held in its released position, under the bias of springs 72 and 73, against surface 25 of link 23 awaiting closing of the door for automatic locking thereof.

When the "lost motion" connection between electric motor 81 in bolt 63 is operated by the motor control means 83 to the position in FIG. 7, slide bolt 91 having been moved away from the stop shoulders 89 and 90, the bolt is ready to automatically lock the safe door bolt works upon closing of the door. Referring to FIGS. 7 and 8, when the safe door is closed and the door handle 11 is rotated a quarter turn in a counterclockwise direction back to the position as illustrated in FIG. 1, the link will be shifted downwardly in FIG. 7 relative to bolt 63 such that gate 64 will come into alignment with bolt 63 and the bolt will automatically shift into the bolt works locking position of FIG. 8 under the urging of its bias provided by springs 72 and 73. The bolt works of the safe door are thus automatically locked by the associated electronic lock of the present invention when the door is closed and the bolt works thrown into a door locking position. It is not necessary to turn a locked dial or manipulate an electronic code input means in any manner to cause this automatic locking of the safe door when the door is closed and the handle is moved into its normally door locking position.

Alternatively, a single spring can be provided between the end of the motor shaft 92 and an appropriate bore provided in the facing inner end wall of the bolt slot 86. Such single spring would be captive within the slot 86, simply and easily assembled and reliable under extend use.

Further, the bolt 63 can be provided with a camming end configuration like conventional spring bolts where it is desired to use the lock of the present invention with secured doors not employing bolt works, the spring bolt simply engaging a door jamb receptacle.

Having thus described a preferred exemplary embodiment of the self locking electronic lock for use with a safe door having manually operable bolt works in accordance with present invention, it should now be apparent to those skilled in the art that the various advantages and objects aforestated for the present invention have been attained. Furthermore, it should be apparent to those skilled in the art that various modifications, adaptations and alternative embodiments thereof may be made within the scope of the present invention which is defined by the following claims.

We claim:

1. A self locking electronic lock for use with a safe door having manually operated bolt works including a door handle, linkage operated by said handle and door bolts operated by said linkage, said linkage having a lock bolt receiving gate whereby said linkage is immobilized when a lock bolt is received in said gate to thereby lock said safe door, said electronic lock comprising:

a biased lock bolt and mounting means for mounting said lock bolt relative said linkage whereby said bolt is normally biased into said linkage gate when aligned thereto in a linkage locking position and biased against said linkage when not aligned to said gate, in a linkage engaging position whereby manipulation of said linkage by said handle to align said gate to said lock bolt causes said lock bolt to automatically enter said gate due to its bias toward such linkage locking position.

2. The self locking electronic lock of claim 1 wherein said lock further comprises:

electrically driven means for withdrawing said lock bolt against its bias from said gate on actuation thereof and for thereafter releasing said lock bolt whereby said lock bolt may assume its linkage engaging position if said linkage has been manipulated to move said gate out of alignment with said lock bolt when said lock bolt has been withdrawn therefrom by said electrically driven means.

3. The self locking electronic lock of claim 2 wherein said electrically driven means further comprises:

a lost motion connection with said lock bolt whereby said electrically driven means is operable between a lock bolt withdrawn position and lock bolt released position and said lock bolt may remain in a lock bolt withdrawn position engaging against said linkage when said electrically driven means assumes said lock bolt released position following operation thereof to said lock bolt withdrawn position and said linkage has been manipulated to move said gate out of alignment with said lock bolt.

4. A self locking electronic lock for use with a safe door having manually operated bolt works including a door handle, linkage operated by said handle and door bolts operated by said linkage, said linkage having a lock bolt receiving gate whereby said linkage is immobilized when a lock bolt is received in said gate to thereby lock said safe door, said electronic lock comprising:

a biased lock bolt mounting means for mounting said lock bolt relative said linkage whereby said bolt is normally biased into said linkage gate when aligned thereto in a linkage locking position and biased against said linkage when not aligned to said gate, in a linkage engaging position whereby manipulation of said linkage by said handle to align said gate to said lock bolt causes said lock bolt to automatically enter said gate due to its bias toward such linkage locking position; and electrically driven means for withdrawing said lock bolt against its bias from said gate on actuation thereof and for thereafter releasing said lock bolt whereby said lock bolt may assume its linkage engaging position if said linkage has been manipulated to move said gate out of alignment with said lock bolt when said lock bolt has been withdrawn therefrom by said electrically driven means wherein said electrically driven means further comprises:

a lost motion connection with said lock bolt whereby said electrically driven means is operable between a lock bolt withdrawn position and lock bolt released position and said lock bolt may remain in a lock bolt withdrawn position engaging against said linkage when said electrically driven means assumes said lock bolt released position following operation thereof to said lock bolt withdrawn position and said linkage has been manipulated to move said gate out of alignment with said lock bolt; and a reversible electric motor having a rotor shaft extending therefrom, said shaft being provided with a threaded portion thereon to engage with said lost motion connection with said lock bolt.

5. The self locking electronic lock of claim 4 wherein said lost motion connection with said lock bolt comprises:

a slot in said lock bolt and a follower block located in said slot, said block having a threaded bore receiving said rotor shaft, to be movable in said slot on operation of said motor, said slot having at least one block abutment surface whereby said lock bolt is moved to its withdrawn position by movement of said follower block when said block abuts said surface and releases said lock bolt when moved in said slot away from said surface.

6. An electrically operated lock having a housing and comprising:

a spring biased bolt and mounting means for mounting said bolt to said housing for movement inward and outward of said housing, said bolt being normally biased outwardly of said housing;

an electric motor having a rotor shaft and connecting means between said rotor shaft and bolt for moving said bolt inwardly of said housing against its bias by operation of said motor; and electrical means for selectively operating said motor to move said bolt.

7. The electrically operated lock of claim 6 wherein said connecting means comprises:

a lost motion connection between said motor shaft and bolt whereby said bolt is selectively moveable independently of said motor shaft.

8. The electrically operated lock of claim 7 wherein:

said motor is a reversible motor for reversing the direction of rotation of said rotor shaft; and said connecting means includes a follower block and means for providing a lost motion connection between said block and said bolt, said bolt having a drive thread connection to said shaft whereby selective rotation of said shaft causes selective movement of said block relative said bolt.

9. An electrically operated lock having a housing and comprising:

a spring biased bolt and mounting means for mounting said bolt to said housing for movement inward and outward of said housing, said bolt being normally biased outwardly of said housing;

an electric motor and connecting means between said motor and bolt for moving said bolt inwardly of said housing against its bias by operation of said motor;

electrical means for selectively operating said motor to move said bolt;

a lock combination entry means for receiving entry of a predetermined lock opening combination;

a signal generating means operated by said entry means for sending a motor operating signal to said motor to move said bolt when said predetermined combination is entered on said entry means wherein said signal generating means is provided to first operate said motor in a first bolt withdrawal mode to cause movement of said bolt inwardly of said housing, then in a second mode wherein said motor is in a dwell condition and then in a third mode wherein said motor is reversed; and said connecting means includes a lost motion connection between said motor and bolt whereby said bolt is movable independently of said motor when said motor has been operated in said third mode.

10. A self locking electronic lock system for use with safe doors having a door locking bolt works manipulated between door open and door locked positions by a door mounted handle, said lock system comprising:

an electronic lock combination entry means for receiving a predetermined lock opening combination and signal generating means for generating an electrical signal when said lock opening combination is entered;

a lock bolt and means for mounting said lock bolt for movement into and out of a bolt works locking position; and electric motor means having a rotor shaft operable by said signal and connecting means between said rotor shaft and bolt for moving said bolt on operation of said motor.

11. The electronic lock system of claim 10 wherein said connecting means includes a lost motion connection between said rotor shaft and lock bolt and biasing means are provided for biasing said lock bolt toward said bolt works locking position.

12. A self locking electronic lock system for use with safe doors having a door locking bolt works manipulated between door open and door locked positions by a door mounted handle, said lock system comprising:

an electronic lock combination entry means for receiving a predetermined lock opening combination and signal generating means for generating an electrical signal when said lock opening combination is entered;

a lock bolt and means for mounting said lock bolt for movement into and out of a bolt works locking position; and electric motor means operable by said signal and connecting means between said motor and bolt for moving said bolt on operation of said motor wherein said connecting means includes a lost motion connection between said motor and lock bolt;

biasing means are provided for biasing said lock bolt toward said bolt works locking position; and said bolt works includes a lock bolt receiving gate provided in a bolt engaging surface and said means for mounting said lock bolt mounts said bolt to be normally biased against said bolt engaging surface when said bolt works is in a door open position and automatically into said gate when said bolt works is manipulated to said door locked position.

* * * * *